US005886276A

United States Patent [19]

Levine et al.

[11] Patent Number: 5,886,276

[45] **Date of Patent: *Mar. 23, 1999**

[54] SYSTEM AND METHOD FOR MULTIRESOLUTION SCALABLE AUDIO SIGNAL ENCODING

[75] Inventors: Scott N. Levine, Palo Alto; Tony S. Verma, Stanford, both of Calif.

[73] Assignee: The Board of Trustees of the Leland Stanford Junior University, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 7,995

[22] Filed: Jan. 16, 1998

Related U.S. Application Data

[60] Provisional application No. 60/035,576, Jan. 16, 1997.

[51] Int. Cl. [6] ..... G10H 1/12

[52] U.S. Cl. ..... 84/603; 84/661; 84/DIG. 9; 704/209; 704/220; 704/268

[58] Field of Search ..... 84/603, 621, 661, 84/683, 691, 699, 700, DIG. 9; 704/205–210, 220, 258–269

[56] References Cited

U.S. PATENT DOCUMENTS

| | | | |
|---|---|---|---|
| 5,202,528 | 4/1993 | Iwaooji | 84/661 X |
| 5,502,277 | 3/1996 | Sakata | 84/661 |
| 5,691,496 | 11/1997 | Suzuki et al. | 84/661 |

OTHER PUBLICATIONS

N.J. Fliege et al, "*Multi–Complementary Filter Bank*", Hamburg University of Technology, ICASSP, 1993, pp. 1–4.

Anderson, "*Speech Analysis and Coding Using A Multi–Resolution Sinusoidal Transform*", Georgia Institute of Technology, 0–7803–3192–3/96 1996 IEEE, pp. 1037–1040.

McAulay et al., "*Speech Analysis/Synthesis Based On A Sinusoidal Representation*", IEEE Transactions On Acoustics, Speech, And Signal Processing, vol. ASSP–34, No. 4, Aug. 1986, pp. 744–754.

(List continued on next page.)

*Primary Examiner*—Stanley J. Witkowski

*Attorney, Agent, or Firm*—Gary S. Williams; Flehr Hohbach Test Albritton & Herbert LLP

[57] ABSTRACT

An audio signal analyzer and encoder is based on a model that considers audio signals to be composed of deterministic or sinusoidal components, transient components representing the onset of notes or other events in an audio signal, and stochastic components. Deterministic components are represented as a series of overlapping sinusoidal waveforms. To generate the deterministic components, the input signal is divided into a set of frequency bands by a multi-complementary filter bank. The frequency band signals are oversampled so as to suppress cross-band aliasing energy in each band. Each frequency band is analyzed and encoded as a set of spectral components using a windowing time frame whose length is inversely proportional to the frequency range in that band. Low frequency bands are encoded using longer time frames than higher frequency bands. Transient components are represented by parameters denoting sinusoidal shaped waveforms produced when the transient components are transformed into a real valued frequency domain waveform. Stochastic or noise components are represented as a series of spectral envelopes. The parameters representing the three signal components compose a stream of compressed encoded audio data that can be further compressed so as to meet a specified transmission bandwidth limit by the deleting the least significant bits of quantized parameter values, reducing the update rates of parameters, and/or deleting the parameters used to encode higher frequency bands until the bandwidth of the compressed audio data meets the bandwidth requirement. Signal quality degrades in a graduated manner with successive reductions in the transmitted data rate.

27 Claims, 6 Drawing Sheets

OTHER PUBLICATIONS

Serra et al., "*Spectral Modeling Synthesis: A Sound Analysis/Synthesis System Based On A Deterministic Plus Stochastic Decomposition*", Department of Music, Stanford University, Jun. 30, 1990, pp. 1–21.

Bosi et al., "*ISO/IEC MPEG–2 Advanced Audio Coding*," Presented at the 101st Convention Nov. 8–11, 1996, Los Angeles, California, Nov. 1996, an Audio Engineering Society Preprint, 4382 (N–1), pp. 1–31.

Maher, "*A Method For Extrapolation Of Missing Digital Audio Data*", J. Audio Eng. Soc., vol. 42, No. 5, May 1994, pp. 350–357.

Edler et al., "*ASAC—Analysis/Synthesis Codec For Very Low Bit Rates*", Presented at the 100th Convention May 11–14, 1996, Copenhagen, an Audio Engineering Society Preprint 4179 (F–6), pp. 1–15.

Hamdy et al., "*Low Bit Rate High Quality Audio Coding With Combined Harmonic And Wavelet Representations*", University of Minnesota, ICASSP, 1996, pp. 1–3.

SYSTEM AND METHOD FOR MULTIRESOLUTION SCALABLE AUDIO SIGNAL ENCODING

This application claims benefit of USC Provisional Appl. No. 60/035,576, filed Jan. 16, 1997.

The present invention relates generally to systems for analyzing, encoding and synthesizing audio signals, and also to systems for transmitting compressed, encoded audio signals over variable bandwidth communication channels.

BACKGROUND OF THE INVENTION

It is a basic premise of audio signal encoding techniques that if one has a perfect model of the instrument or device that is creating a sound, then the amount of data required to encode the sound will be very small, resulting in very high data compression ratios. For instance, to record a piano (or any other instrument) playing a single note, such as middle C, using full compact disk (CD) recording techniques (e.g., 44,100 samples per second, 16 bits per sample), results in a huge amount of information per second (e.g., 705.6 kbps or 88,200 bytes per second). However, if it is known that the sound being recorded emanates from a piano and both the sound analysis system that is recording the sound, and the receiving systems that will reproduce the recorded sound, have perfect models of the piano, then the only data required will be the data required to indicate the note being played (1 byte is more than sufficient to which of the 88 notes on a piano), and the note's amplitude (perhaps 1 additional byte), plus data sufficient to identify the beginning and ending of the playing of that note. (This is equivalent to the data on a printed page of music.) In a simple data recording system using a piano model, data identifying the piano note being played can be recorded once every sample period, where a typical sample period would be 10 or 20 milliseconds, resulting a data recording rate of 100 to 200 bytes per second. Obviously a data rate of 200 bytes per second represents a great deal of data compression from the full 88,200 bytes per second rate, and in fact indicates a compression ratio of 441 to 1. In more realistic, real world audio analysis and recording systems, compression ratios of 10 to 1 or so are generally considered to be very good.

As presented in U.S. Pat. No. 5,029,509, the use of sinusoidal modeling for speech and audio signals is well established. In audio signal analysis and recording systems using sinusoidal modeling, an audio signal is analyzed each sample period to determine the sinusoidal signal components of the signal during that sample period. For example, the sinusoidal components will often be a fundamental frequency component and a set of harmonics. Any portion of the signal not easily represented as sinusoidal components is typically represented as stochastic noise through the use of noise envelope parameters.

However, actual applications of sinusoidal modeling have been generally limited to single-speaker speech and single-instrument (monophonic) audio. More recently, there have been various attempts to perform sinusoidal modeling on wideband, polyphonic (or multisource) audio signals for the purposes of data compression. The present invention provides an improved audio signal analysis and representation method that provides significant benefits and better compression than the prior systems known to the inventors.

In traditional sinusoidal analysis methods, the input audio signal is first broken into uniformly sized segments (e.g., 5 to 50 millisecond segments), and then processed through one or several fast Fourier transforms (FFT) to determine the primary frequency components of the signal being processed. The process of breaking the input sound into segments is referred to in the literature as "windowing", or multiplying the input digital audio with a finite-length window function. Once the spectral peaks have been identified, parameters (such as frequency, amplitude, and phase) for each spectral component are determined, quantized and then stored or transmitted. This method works well if the input is a monophonic source, and the traditional analysis methods can determine what the single fundamental frequency happens to be.

In the case of general audio signal compression, there can be any number of audio sources (polyphonic) and thus multiple fundamental pitches. It is well known that the traditional methods of windowing and frequency component identification give poor results on wideband audio signals.

The present invention is premised on the theory that the aforementioned poor results are caused primarily by two problems: 1) a fundamental tradeoff between time resolution and frequency resolution, and 2) failure to accurately model the onset of each note or other audio event. The present invention also addresses the failure of prior art systems to provide graceful degredation of signal quality as the data transmisison bandwidth is gradually decreased and/or as an increasing fraction of the transmitted data is lost during transmission.

The tradeoff between time resolution and frequency resolution manifests itself in the following scenario. If signal analysis procedure is designed to have very good pitch resolution, say, ±5 Hz, which may be necessary for resolving bass notes, then the corresponding window will have to be about 200 milliseconds long. As a result, the analysis procedure will have very good pitch resolution, but the time resolution (i.e., the determination of the temporal onset and termination of each fequency component) will be very poor. Any time a partial begins (a new frequency track), its attack will be smeared across the entire window of 200 milliseconds. This makes the attack dull, and gives rise to a problem called "pre-echo". When a receiving system synthesizes an audio signal based on the audio parameters generated while using wide windows, synthesized coding error noise (like smeared partial attacks) is heard before the actual attack begins, this is known as "pre-echo".

Another problem associated with prior art audio data encoders is that the compressed audio data produced by those encoders is not easily scaled down to lower data rates. Most high-quality wideband audio algorithms in use as of the end of 1996 (such as MPEG and AC-3) use perceptual transform coders. In these systems the digital audio is broken into frames (usually 5 to 50 milliseconds long), each frame is converted into spectral coefficients using a time-domain aliasing cancellation filter bank, and then the spectral coefficients are quantized according to a psychoacoustic model. The most recent version of these "transform-based" audio coders, known as MPEG2-AAC, can have very good compression results. A CD-quality sound signal having 44100 samples per second and 16 bits per sample, having 22 kHz bandwidth and a data rate of 705.6 kbps is compressed to a signal having a data rate of about 64 kbps/sec, which represents a compression ratio of 11:1.

While 11:1 is a very good compression ratio, transform coders have their limitations. First of all, if the available transmission data rate (i.e., between a server system on which the compressed audio data is stored and a client decoder system) drops below 64 kbps, the sound quality decreases dramatically. In order to compensate for this loss of quality, the original audio input must be band limited in order to reduce the data rate of the compressed signal. For example, instead of compressing all audible frequencies from 0–20000 Hz, the encoding system may need to lowpass filter any frequencies above 5500 Hz in order to compress the audio to fit in a 28.8 kbps transmission channel, which is the typical bandwidth available using the modems most frequently found on desktop computers in 1997.

Another limitation of the transform encoders are that the encoding technique is not scalable. On a computer network like the Internet, the actual bandwidth available to a user with a 28.8 kbps modem is not guaranteed to be 28.8 kbps. Sometimes, maybe, the user will actually received 28.8 kbps, but the actual available bandwidth can easily drop at various times to 18 kbps, 6 kbps, or anywhere in between. If a transform coder compresses audio to generate encoded data having a data rate of 28.8 kbps, and the data rate suddenly drops to only 20 kbps, the audio quality of the sounds produced by client decoder systems will not gracefully degrade. Rather, the transform coder will produce silence, noise bursts, or poor time-domain interpolation. Clearly, it would be highly desirable for the quality of the sounds synthesized by client decoders to degrade gracefully as the available bandwidth decreases and when random data packets are dropped or lost during transmission. Gracefully degradation means that the listener will not hear silence or noise, but rather a gradual decrease in perceptual quality.

SUMMARY OF THE INVENTION

In order to enable a more accurate analysis of polyphonic (multisource) signals that avoids the pre-echo problem, the present invention uses a multiresolution approach to spectral modeling.

In summary, the present invention is a musical sound or other audio signal analysis system that is based on a model that considers a sound to be composed of three types of elements: deterministic or sinusoidal components, transient components representing the onset of notes or other events in an audio signal, and stochastic components. The deterministic components are represented as a series of overlapping sinusoidal waveforms. To generate the deterministic components, the input signal is divided into a set of frequency bands by a multi-complementary filter bank 132. The frequency band signals are oversampled so as to suppress cross-band aliasing energy in each band. Each frequency band is analyzed and encoded as a set of spectral components using a windowing time frame whose length is inversely proportional to the frequency range in that band. Thus, low frequency bands are encoded using much longer windowing time frames than higher frequency bands.

The transient components are represented by parameters denoting sinusoidal shaped waveforms produced when the transient components are transformed into a real valued frequency domain waveform by an appropriate transform. The stochastic or noise component is represented as a series of spectral envelopes.

From the representation of audio signals by parameters representing the above described three signal components, sounds can be synthesized that, in the absence of modifications, can behave as perceptual identities, that is, they are perceptually equal to the original sound. Furthermore, the compressed encoded audio data can be further compressed so as to meet a specified transmission bandwidth limit by the deleting the least significant bits of quantized parameter values, reducing the update rates of parameters, and/or deleting the parameters used to encode higher frequency bands until the bandwidth of the compressed audio data meets the bandwidth requirement. Due to the manner in which the audio signal is encoded, signal quality degrades gracefully, in a graduated manner, with successive reductions in the transmitted data rate.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENTS

Figure 1:
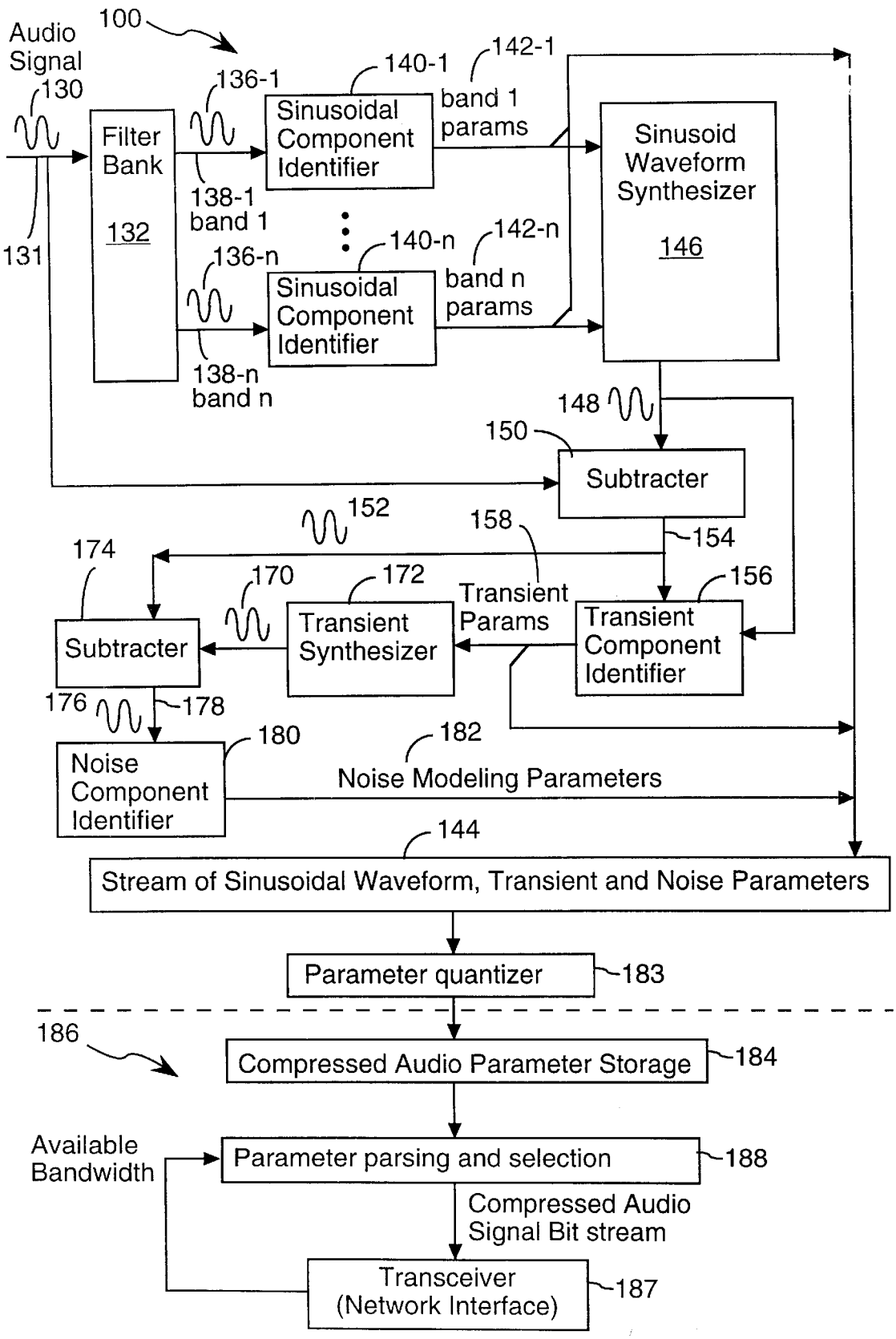
FIGS. 1 and 2 are block diagrams of a polyphonic audio signal analysis system.
Figure 2:
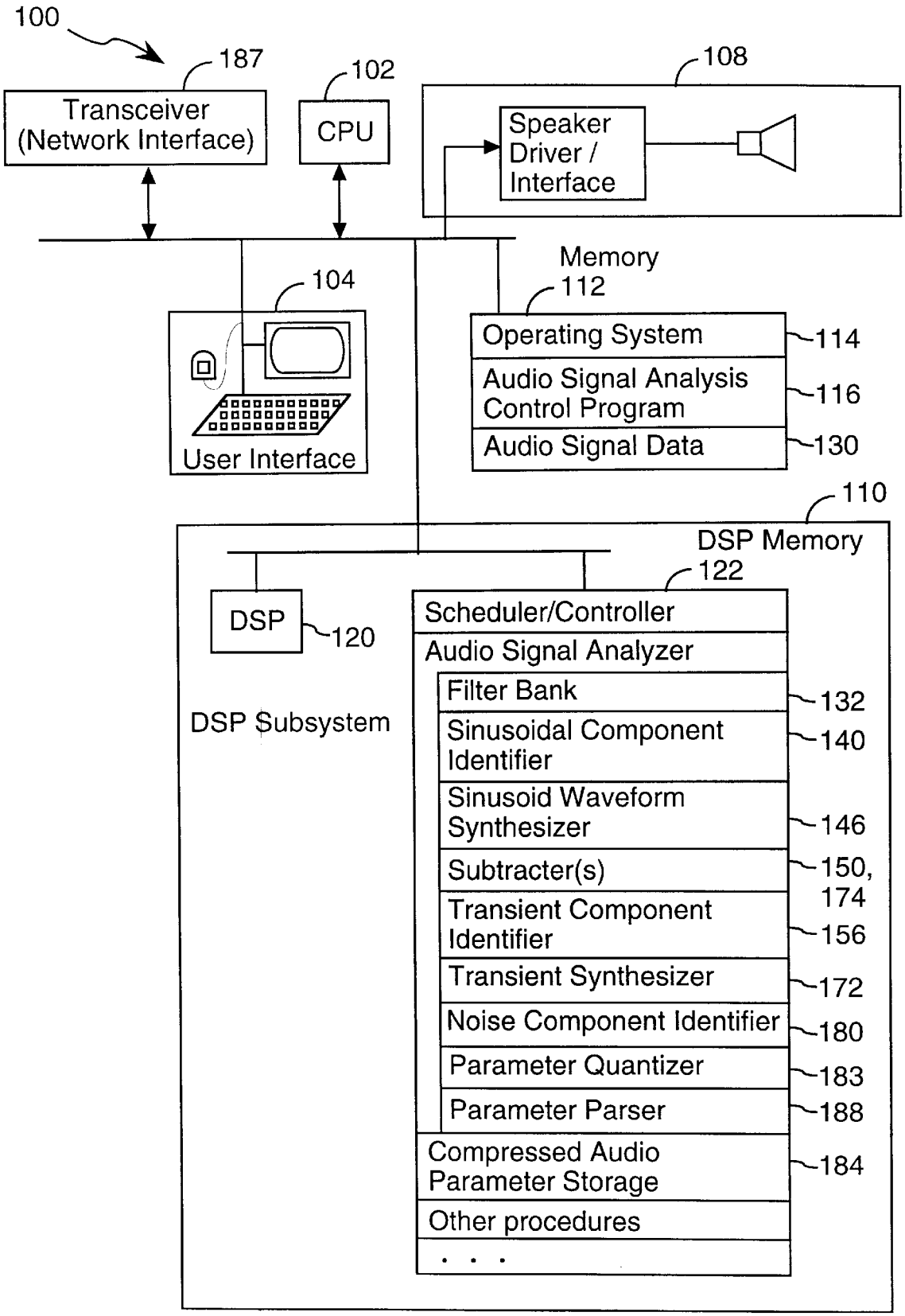

FIG. 1 shows a "signal flow" representation of an audio signal analyzer and encoding system 100, while FIG. 2 depicts a preferred computer hardware implementation of the same system. The primary purpose of the analyzer/encoder system 100 is to generate a compressed data stream representation of an input audio signal that efficiently represents the psychoacoustically significant aspects of the input audio signal. Typically, the compressed audio data will be stored in computer storage devices or media. The compressed audio data is delivered either on media or by various communication channels (such as the Internet) to various client decoder systems 200 (see FIGS. 5, 6). The compressed audio data is encoded by the analyzer/encoder system 100 in a way that facilitates further compression of the audio data so as to meet any specified communication bandwidth limitation and to enable "graceful degradation" (also called gradual degradation) of the quality of the audio signal produced by decoder systems 200 as the available communication bandwidth decreases (i.e., the signal quality of the regenerated audio signal is comensurate with the available bandwidth). The client decoder systems 200 synthesize a regenerated audio signal from the received, compressed audio data.

The server computer(s) used to communicate compressed audio data to client decoder systems 200 may be different computers than the analyzer/encoder computers 100 used to encode audio signals.

The audio signal analyzer/encoder system 100 preferably includes a central processing unit (CPU) 102, a user interface 104, an audio output device 108, a digital signal processor (DSP) subsystem 100, and memory 112. Memory 112, which typically includes both random access memory and non-volatile disk storage, stores an operating system 114, an audio signal analysis control program 116, and audio signal data 130. The DSP subsystem 110 includes a digital signal processor (DSP) 120 and a DSP memory 122 for storing DSP programs, and compressed audio parameters 124. The DSP programs will be described in more detail below.

The use of a DSP 120 is optional, especially in applications where the audio signal analyzer system 100 does not need to analyze audio data in real time. In an alternate embodiment, the analyzer system 100 simply uses a single, reasonably powerful CPU, such as a 200 MHz Pentium Pro or a 200 MHz PowerPC microprocessor. In these alternate embodiments, all the "DSP procedures" described below are procedures executed by the main (and only) CPU 102, and all the audio analysis and system control procedures are stored in a single, integrated, memory storage system 112.

The analyzer/encoder system 100 receives an audio signal 130 on an input line 131, which may be part of the user interface 104, or may be a data channel from the system's main memory 112. For the purposes of this explanation, it is assumed that the input audio signal 130 is a sampled digital signal, sampled at an appropriate data rate (e.g., 44,100 samples per second). The input signal is first processed by an multi-complementary filter bank 132 that splits the input audio signal into several octave-band signals 136 on lines 138. More generally, the band signals 136 contain contiguous frequency range portions of the input audio signal. A multi-complementary filter is used to guarantee that no aliasing energy is present inside the octave-band signals on lines 136. A description of multi-complementary filters can be found in N. Fliege and U. Zolzer, "Multi-Complementary Filter Bank," ICASSP 1993, which is hereby incorporated by reference as background information.

The multi-complementary filter bank 132 has the same basic filter structure as the pyramid coding filters used for image processing, with an additional lowpass filter in the middle to remove aliased components. In return for having no aliasing energy present, the signals are oversampled by a factor of two. Thus the multi-complementary filter bank 132 used is not a critically sampled filter bank. That is, the band signals 136 generated by the filter 132 are not critically sampled. The term "critically sampled band data" means that the total amount of data (i.e., the number of data samples) is equal to the amount of data (i.e., number of data samples) prior to its division into band data. In the preferred embodiment of the present invention, the number of samples in the band data is twice the number that would be used in critically sampled band data. However, because the analysis system 100 does not quantize the octave band signals directly, but rather generates sinusoidal parameters from them, the oversampling is not a problem. Once again, it is noted that the reason for oversampling the data in each band signal 136 is to suppress cross-band aliasing energy.

In a preferred embodiment, the input audio signal is preprocessed by the filter bank 132 into six octave-band channels at a 44.1 kHz sampling rate. Each octave-band signal 136 has a different length analysis window that is used for generating a respective stream of spectral model synthesis (SMS) parameters 142. This allows bass notes to be correctly analyzed with high frequency precision (using long windows at low frequencies), but also reduces pre-echo problems with high-frequency attacks like cymbals (good time resolution with short windows). The six octave bands used in the preferred embodiment, and the number of subsamples generated by the filter bank for each analysis window are as follows:

TABLE 1

Filter Bank Windows

| band | effective window [samples] | bandwidth [Hz] | window size [ms] | subsamples generated per window period | sampling rate [Fs = 44,100Hz] |
|---|---|---|---|---|---|
| 6 | 128 | 11000–22000 | 2.9 | 128 | Fs |
| 5 | 256 | 5500–11000 | 5.8 | 128 | Fs/2 |
| 4 | 512 | 2750–5500 | 11.6 | 128 | Fs/4 |
| 3 | 1024 | 1375–2750 | 23.2 | 128 | Fs/8 |
| 2 | 2048 | 687–1375 | 46.4 | 128 | Fs/16 |
| 1 | 4096 | 0–687 | 92.9 | 128 | Fs/32 |

The sampling rate in Table 1 refers to the rate of the data in the band relative to the rate of data in the original signal.

The subsamples generated by the filter bank 132 for each octave band are then analyzed by a respective sinusoidal component identifier 140. In a preferred embodiment, the sinusoidal component identifier 140 is implemented using a short time frame FFT. The FFT identifies spectral peaks within each band signal 136, and produces a parameter tuple representing the frequency, amplitude and phase of each identified spectral component. As shown in Table 1, the FFT analysis time frame is different for each band 136. The time frame length for each band 136 is selected to maximize the accuracy of frequency component identification while maintaining reasonably good accuracy on identifying the time at which each frequency component begins and ends.

The time accuracy for frequency component identification depends on (A) the window period, and (B) the hop size (i.e., the number of samples by which the FFT window is advanced for each subsequent frequency analysis of the band signal). If a hop size of 1:1 were used, indicating that each band sample is analyzed by the FFT only once, then the time accuracy of each frequency component would be the same as the window size. In the preferred embodiment, a hop size of 4:1 is used for all channels. In other words, for a channel having 128 samples per window, the FFT is advanced 32 samples for each successive spectral analysis of that band. In addition, the time accuracy of the frequency component identifications is one fourth the window time for each band signal 136.

The sinusoidal component parameters 142 produced by the FFT analysis (i.e., a parameter tuple representing the frequency, amplitude and phase of each identified spectral component) for each respective band signal 136 are components of a stream of parameters 144 generated by audio signal analyzer 100.

The same sinusoidal component parameters 142 are also passed to a sinusoid waveform synthesizer 146, which generates a "deterministic" signal 148 composed of a set of sinusoidal waveforms. Sinusoid waveform synthesizer 146 may use a bank of (software implemented) oscillators, or inverse Fourier transforms, to generate the sinusoidal waveforms. The deterministic signal 148 represents the sinusoidal portion of the input audio signal. A signal subtracter 150 then subtracts the deterministic signal 148 from the input audio signal 130 to generate a first residual signal 152 on line 154.

In summary, the first portion of the audio signal analyzer extracts and parameterizes all periodic, sinusoidal, steady-state energy from the input audio signal 130. By using a multiresolution windowing methodology, the customary tradeoff between time resolution and frequency resolution is avoided.

Transient Modeling

Despite the relatively good time accuracy of the parameters 142 representing the deterministic portion of the input audio signal, and the virtually complete elimination of the "pre-echo" problem, the inventors have found that a synthesized audio signal generated from the deterministic signal parameters 142 is still much "mudier" than the sound quality generated by a music compact disk (CD). Of course, a music CD has a tremendously higher data rate than the parameters 142 generated using the sinusoidal component analysis portion of the analyzer 100, so a difference in sound quality would be expected. However, the inventors have determined that there is a way to analyze and encode a "transient signal portion" of the residual signal 152 in such as way as to compensate for the mudiness of the regenerated deterministic signal 148, while only modestly increasing the overall data rate of the parameter stream 144. The amount of data typically required to encode the transient signal portion of the residual signal is typically one fifth to one half as much data as is required to encode the deterministic portion of the input audio signal.

In a preferred embodiment, the residual signal 152 on line 154 is processed by a transient component identifier 156 to extract sudden attacks or onsets (i.e., when an instrument first begins to play a note) in the input audio signal 130. These transients, or onsets, are not periodic or steady-state in nature. Therefore, the present invention uses a different parametric model to characterize them. From another viewpoint, the transients being encoded by the transient component identifier represent the difference between the "true sinusoidal portion," including note attacks, onsets and endings, of the input audio signal, and the deterministic signal 148. By efficiently identifying and encoding these transitions, a much more accurate representation of the non-stochastic portion of the input audio signal is produced.

To analyze and parameterize the transients in an input audio signal, the present invention exploits the duality of time and frequency. The transient analyzer 156 finds time domain transients by (A) mapping frames (also called time segments) of the original time domain signal into the frequency domain, (B) determining the spectral peaks of the resulting frequency domain signal, and (C) generating SMS-like parameter tuples (i.e., frequency, amplitude and phase) to represent the identified spectral peaks. The resulting parameters can be used by a decoder system 200 (described below with reference to FIGS. 5 and 6) to accurately regenerate the transient components of an audio signal.

Figure 3:
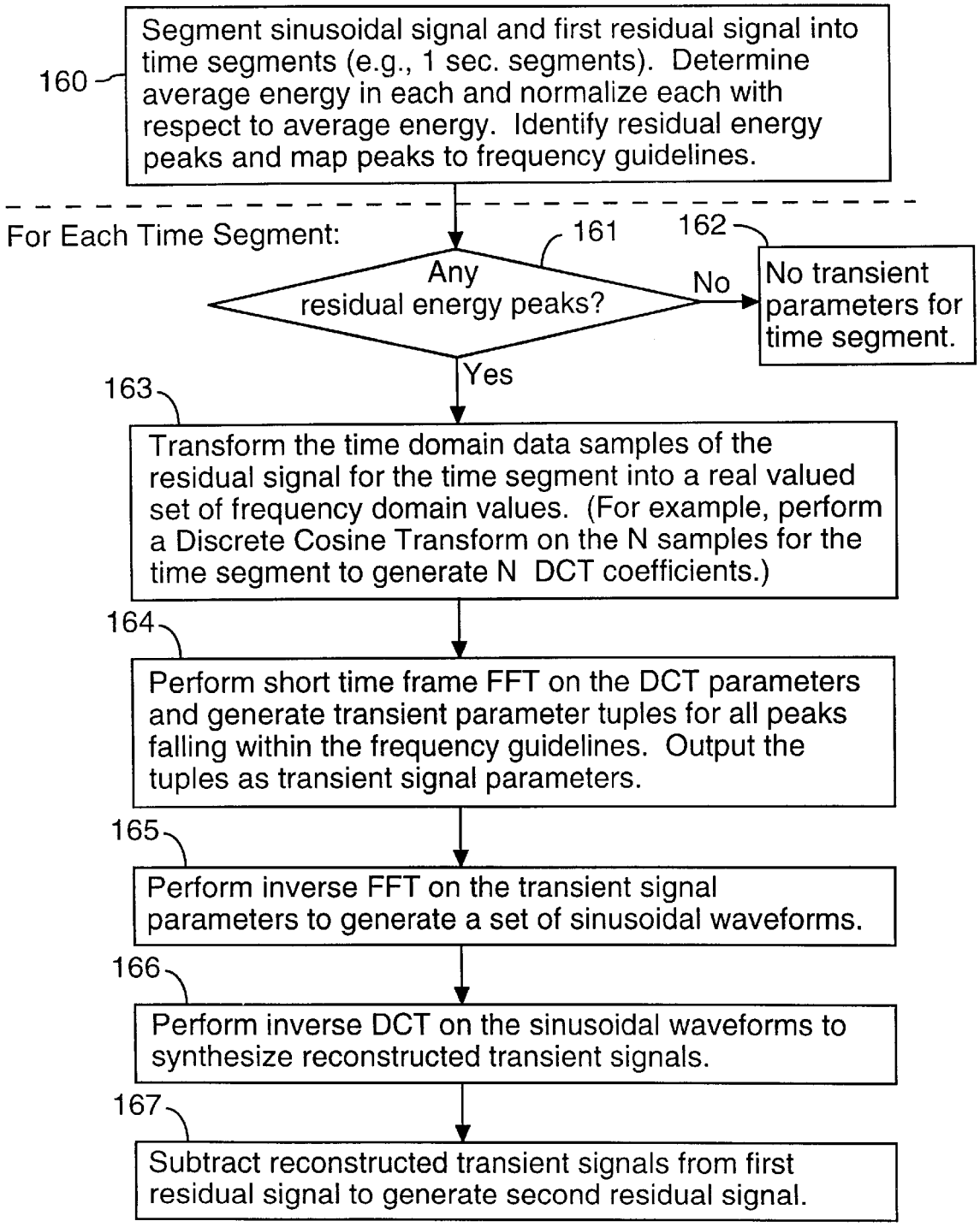
FIG. 3 is a flow chart depicting operation of a portion of the audio signal analysis system that performs transient signal analysis and synthesis of a reconstructed transient signal waveform.

More specifically, referring to FIG. 3, the transient signal component identifier 156 (which is preferably implemented as a set of data analysis procedures executed by the encoding system's CPU 102 or DSP 120) first segments the residual signal 152 on line 154 and the regenerated deterministic signal 148 into a set of frames, herein called time segments, such as 1 second time segments (step 160). For each time segment, a first average energy value is computed for the residual signal 152 and a second average energy value is computed for the deterministic signal 148, and both signals are normalized with respect to the their average energy levels for that time segment. Thus, the two normalized signals each have, on average, equal normalized energy levels. Next, the normalized residual signal (for the time segment) is scanned for energy peaks. In a preferred embodiment, this peak detection is performed by further segmenting the normalized residual and deterministic signals into mini-segments (e.g., 2 or 3 milliseconds each in duration), and then making the following determination for each mini-segment i:

If $(NE(RS)i-NE(DS)_i>\Delta)$ {then a residual energy peak is located in mini-segment i } where $NE(RS)_i$ represents the normalized energy of the residual signal for mini-segment i, $NE(DS)_i$ represents the normalized energy of the determinstic signal for mini-segment i, and $\Delta$ represents a normalized threshold value (typically a value between 0.01 and 1, such as 0.5). Once all the mini-segments with residual energy peaks have been identified, each such identified peak is converted into a pair of frequency values called a "frequency guideline" in accordance with the position of the peak in the time segment.

To give an even more specific example, given an analysis/encoder system 100 in which the input audio signal 130, deterministic signal 148 and the residual signal 152 are each digital sampled signals with 44,100 samples per second, the deterministic and residual signals are segmented into 1 second segments, each having 44,100 samples, and are each normalized with respect to their respective average energy levels for the 1 second segment. Each time segment is then divided into 441 mini-segments, each having 100 samples (representing about 2.2 milliseconds of data). The normalized energy of the residual and deterministic signals are then determined for each 100-sample mini-segment, and the threshold comparison is made to determine which mini-segments represent residual energy peaks.

If, for example, the 2nd, 100th and 221st mini-segments are the ones with residual energy peaks, the mapping of those peaks into frequency guides works as follows. The three mini-segments with energy peaks represent the following data samples in the larger time segment: 101–200, 9901–10000, and 22001–22100. These are each converted into "frequency guidelines" simply by dividing each data sample position value by two and rounding down to the closest integer:

Frequency Guidelines=50–100 Hz, 4950–5000 Hz, and 11000–11050 Hz.

Thus, residual energy peaks close to the beginning of a time segment are mapped to low frequencies and residual energy peaks closer to the end of the time segment are mapped to higher frequencies.

If no residual energy peaks are detected in a time segment (step 161), no transient signal parameters are generated for that time segment (step 162). Otherwise, transient signal parameters are generated for the time segment, using the above determined frequency guidelines, as follows (steps 163–167). The first step of this process (step 163) is to transform the data samples of the residual signal for the time segment into a real valued set of frequency domain values. The transform used in the preferred embodiment is the Discrete Cosine Transform (DCT). The mapping performed by the time to frequency domain transformation causes transients in the time domain to become sinusoidal in the frequency domain. Other transforms that could be used for this purpose include the modified DCT, the Discrete Sine Transform (DST), and modulated lapped transforms.

When a DCT is performed on the 44,100 samples of the residual signal time segment, the transform generates 44,100 real valued DCT coefficients. In step 164, these DCT coefficients are treated as though they were a time domain signal for the purpose of locating sinusoidal waveforms in the DCT "signal." More particular, in step 164, the DCT coefficients are analyzed using a short time FFT to detect sinusoidal waveforms in the DCT signal. In a preferred embodiment, the FFT uses a window size of 2048 samples, and a hop size of 2:1 (meaning that there is a 50 percent overlap between successive windows analyzed by the FFT). For each of the FFT windows (44 such windows are used in the preferred embodiment for each time segment), all frequency peaks located between the guideline frequencies are identified and identification tuples (e.g., indicating frequency, amplitude and phase) are generated as the transient signal parameters. These 44 sets of identification tuples represent the transient portion of the residual signal 152.

The transient signal parameters 158 are similar to the sinusoid component parameters 142 used to represent the deterministic portion of the input signal, except that the transient signal parameters 158 represent a frequency domain mapping of a time domain signal, whereas the sinusoidal component parameters 142 represent the frequency components of a time domain signal. Typically, the transient signal parameters 158 are a very sparse set of parameters and will have a lower associated data rate than the corresponding sinusoidal component parameters 142.

As an example, if there were an ideal impulse in the first residual signal 148, then the transient component identifier 156 would initially take perform a DCT of a frame of data that included the impulse. If the impulse were at the beginning of the frame (in time), then the DCT coefficients corresponding to the impulse would form a low frequency sinusoid waveform. If the impulse were at the end of the frame, then the DCT coefficients corresponding to the impulse would form a high frequency sinusoid waveform. Sinusoidal modeling is performed on the DCT coefficients. The FFT procedure used to analyze the DCT coefficients does not "know" that it is processing DCT coefficients and not time-domain data. If the FFT procedure locates a DCT-domain sinusoid, a low-bandwidth parametric representation of that sinusoid is generated.

In order to increase the effectiveness and efficiency of the transient signal identification process, the procedure restricts the spectral peaks of the frequency domain signal to those associated with residual energy peaks detected in step 160. Since the DCT of a transient signal is a sinusoidal waveform, determining where transients occur in the time domain enables the procedure to know, in advance, what range of sinusoidal components will exist in the frequency domain signal. The tracking of spectral peaks of the frequency domain signal is restricted to these sinusoidal components. Of course, in alternate embodiments, steps 160–162 could be skipped, so as to not to restrict the frequency domain tracking of transient signals.

Noise Modeling

To model and encode the stochastic, noise component of the input audio signal 130, a transient component signal 170 corresponding to the transient signal parameters 158 is generated by a transient signal synthesizer 172 and subtracted from the first residual signal 152 by a signal subtracter 174 to generate a second residual signal 176 on line 178. The transient signal synthesizer 172 generates the transient component signal 170 by performing an inverse FFT on the transient signal parameters (or by using a bank of oscillators) so as to generate a set of sinusoidal waveforms (FIG. 3, step 165), and performing an inverse DCT on those sinusoidal waveforms to synthesize a reconstructed transient signal 170 for the relevant time segment (step 166). The reconstructed transient signal is then subtracted from the first residual signal 152 to generate a second residual signal 176 (step 167).

The second residual signal 176 represents the stochastic portion of the input audio signal after subtraction of the deterministic, sinusoidal components and transient components represented by the sinusoidal component parameters 142 and the transient component parameters 158. In a preferred embodiment, this remaining, second residual signal 176 is analyzed and encoded in the same manner as taught by U.S. Pat. No. 5,029,509. Since the second residual signal 174 is typically a low level, slowly varying "noise floor," it can be encoded by a noise component encoder 180 in several different ways. For instance, the second residual signal can be encoded by the noise component encoder 180 as a line segment approximation of the residual signal's spectral envelope (i.e., by a set of magnitude values for a number of discrete frequency values). Alternately, the spectral envelope of the residual noise signal 176 can be represented as a set of LPC (linear predictive coding) coefficients, or an equivalent set of lattice filter coefficients. Thus, the noise component encoder 180 typically operates by performing a FFT spectral analysis of the residual noise signal 174, and then generating a set of values or coefficients 182 that represent the spectral envelope of the residual noise signal 174.

Quantization, Storage and Bandwidth Limited Transmission of Compressed Audio Data The sinusoidal component parameters 142, transient component parameters 158, and noise modeling parameters 182 together form a data stream 144 representing the input audio signal. Prior to "permanent storage" of the data stream 144, the parameters in this data stream are first quantized by a parameter quantizer procedure 183 in accordance with a psychoacoustic model so as to reduce the number of data bits requiring storage. In other words, more data bits are allocated to perceptually important parameters than less important parameters. In a preferred embodiment, groups of parameters within each octave band are quantized as a group using a well known technique called vector quantization, where each quantized vector represents a set of several parameters. For instance, one vector might be used to represent the frequency and amplitude of the four strongest frequency components of a particular octave band. Furthermore, the quantized vectors are organized in a tree structure such that if the N least significant bits of the vector representation are deleted (and replaced by a fixed value such as 0 by the receiving decoder system), the resulting selected quantized vector remains the best vector representation of the associated parameters for the number of bits used to represent the vector. Vector quantization is very efficient in contexts in which there are detectable time or frequency patterns or correlations associated with various audio "voices" in the input audio signal. For instance, an instrument such as a person's voice or a cello will typically have a detectable pattern of harmonics for each note that repeat from one time sample period to the next.

In general, regardless of whether the generated parameters are quantized in groups using vector quantization or parameters are quantized individually, or some combination thereof, the quantization for each parameter or group of parameters is performed in such a way that the number of bits for each parameter or group can be reduced simply by eliminating a selected number of the least significant bits of the quantized parameter or group in accordance with any specified "data compression level". Thus, a parameter that is quantized and encoded with 6 bits of data will still have meaning and will be useable by a client decoder system if one or two (or even more) of its least significant bits are dropped in order to achieve a target data stream bandwidth.

Figure 4:
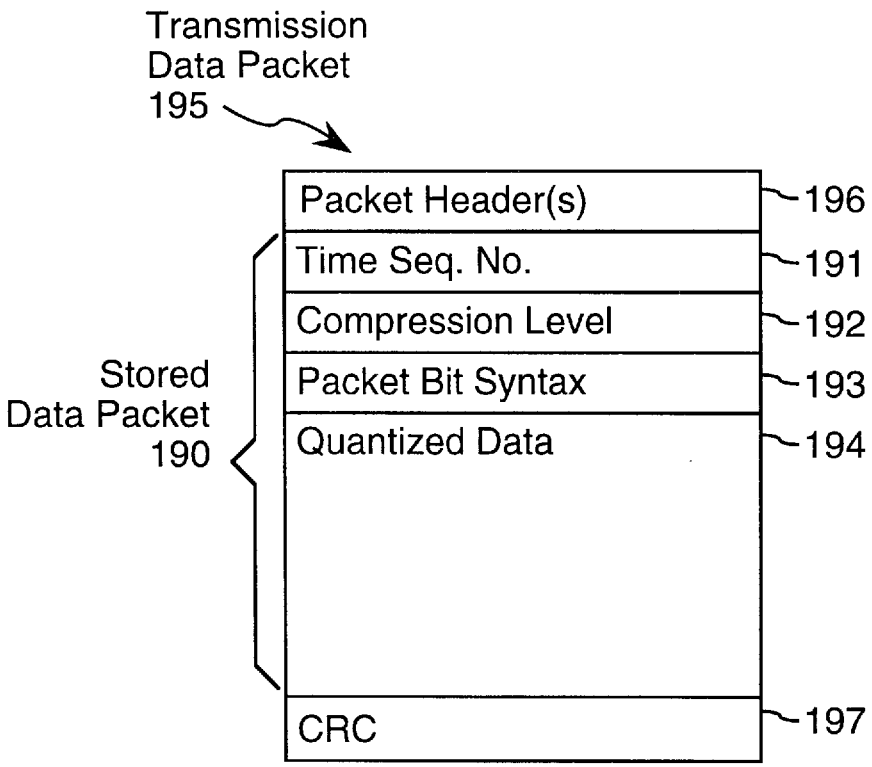
FIG. 4 depicts the format of a packet of compressed audio data.

The resulting quantized parameters are called the "compressed audio parameters" or the "compressed audio data," and these are typically stored in a non-volatile storage device 184. More specifically, the quantized parameters are typically grouped into data packets 190 (see FIG. 4) that are then stored in the storage device 184, where the data in each data packet 190 will be the data for one time frame, such as the window period associated with the lowest octave band (e.g., 92.9 milliseconds). Referring to FIG. 4, each data packet 190 stored on device 184 will typically include:

- a time sequence number 191 to indicate the time index associated with the compressed audio data in the packet,
- a four-bit compression level value 192, which is preferably initially set to zero for data packets when they are stored and which may be later reset to a value associated with a lower transmission bit rate at the time the packet is transmitted to a client decoder system;
- a packet bit syntax 193, which indicates how the sinusoidal, transient and noise parameters have been encoded and quantized so that the receiving system can decode the quantized data 194 in the packet; and
- the quantized, compressed audio data 194.

The transient component parameters, which are computed on a 1 second time frame basis, and the noise component parameters, which are also updated relatively slowly, are preferably distributed over the set of data packets representing a 1 second time frame (e.g., 11 data packets).

As indicated in FIG. 4, when a data packet of compressed audio data is transmitted, the corresponding transmission data packet 195 includes one or more packet headers 196 required for routing the packet to one or more destinations, and a data corruption detection value 197, which is usually a CRC value computed on the entire contents of the packet (possibly excluding the packet headers 196, which may include its own, separate CRC value). The packet headers 196 and CRC value 197 are typically generated at the time each data packet is transmitted by the appropriate operating system data transmission protocol procedures. Furthermore, if a data packet representing one time frame would exceed the maximum allowed packet size for a particular communication network, then that packet is segmented into a sequence of smaller packets that satisfy the network's packet size requirements.

Compressed Audio Data Distribution Server or Subsystem

In some contexts, the compressed audio data will be copied onto media such as computer diskettes, CDs, or DVDs for distribution to various server computers or even client computers. Alternately, the encoder computer system 100 can also be used an compressed audio data distribution server. A compressed audio data distribution server (or subsystem) 186 will generally include a storage device 184 that stores a copy of the compressed audio data for one or more "programs," a transceiver 187 (typically a network interface) for transmitting data packets to client decoder systems and for receiving information from the client systems about the available bandwidth between the server and client, and a parameter parser and selecter 188.

In particular, in a preferred embodiment, the parameter parser and selecter 188 receives an available bandwidth value, either from the client decoder system or any other source, and determines from the available bandwidth how much of the encoded audio data to transmit. For example, if the full, CD quality encoded audio data has an associated data rate of approximately 64 kbps, and the available bandwidth is less than 64 kbps, the data to be transmitted is reduced in a sequence of steps until the remaining data meets the bandwidth requirement. In one embodiment, there are 10 data compression levels, the first of which (compression level 0) represents the full set of stored encoded data. The successive data reductions associated with each of the other nine compression levels is as follows:

TABLE 2

Data Compression by Parameter Parsing and Selection

| Compression Level | Data Reduction |
|---|---|
| 1 | Drop sinusoid parameters (and/or groups of parameters) assigned the fewest number of bits in the current frame. |
| 2 | Update the noise signal only 10% as often as usual. |
| 3 | Band limit the signal by deleting parameters representing the highest octave band. |
| 4 | Band limit the signal by cutting the update rate in half for the second highest octave band. |
| 5 | Reduce number of bits used for remaining parameters by deleting the N least significant bits of each parameter. |
| 6 | Delete half of the transient parameters (over the applicable 1 second frame). |
| 7 | Band limit by deleting parameters representing the second highest octave band. |
| 8 | Delete remaining transient parameters and noise parameters. |
| 9 | Transmit only even numbered time frame packets (i.e., transmit only every other data packet). |

As indicated above the data reductions are applied cumulatively, and thus at compression level N all the data reductions associated with compression levels 1 through N are applied. The compression level parameter 192 in each transmitted data packet 195 is set to the compression level used by the transmitting server system.

In an Internet audio data streaming application, two way communication is available between the server (broadcaster of the audio data) and the client decoder system (the listener or receiver). The server delivers compressed audio at a data rate it believes the client can support under current network conditions. If all goes well, the client can receive the exact bit rate the server is supplying with no packet dropouts. If the data rate being transmitted is too high, then the client transmits information back to the server indicating the data rate it can handle. An example of this scenario would be if the server believes the client can receive 20 kbps; but, the network is loaded down for a few minutes because of high traffic, and the client reports it can only receive 12.6 kbps. The server then adapts, changes the compression level of the transmitted audio data stream in real-time, and delivers an audio data stream having a data rate no greater than 12.6 kbps. Of course, if the client can handle a higher data rate than the server is delivering, then the client can communicate that information to the server, and the server will increase the data rate transmitted (and thus increase the quality as well).

Once the server decides which parameters to send and how many bits to allocate to those parameters, the selected data bits are formatted into a bitstream, segmented into packets, and then transmitted to the receiver via the Internet. In this manner, the server will deliver the best quality of audio that the client can accept at any given time. The current representation will allow the server to transmit compressed data at rates as high as 64 kbps (which is perceptually lossless) and as low as 6 kbps (approximately telephone line quality) and almost any data rate in between. This feature of generating, in real time, data streams having a variety of different data rates from a single master encoded file is not possible with transform based encoders such as MPEG and AC-3, which must encode (from the input audio signal) separate streams for use with various preselected channel bandwidths.

In addition, existing commercial systems must pause between switching bit rates, and the pause is usually on the order of seconds. This is due to the fact that such systems must always buffer enough packets to be able to reshuffle them into their correct order (in case they are received in the wrong order). In contrast, the present invention requires no delay or buffering or silence when switching data rates. The transition is perceptually seamless, as different subsets of sinusoidal parameters from the master high-resolution file are transmitted.

As indicated above, if a packet happens to be lost in transmission, then the missing data can be estimated by interpolating in the sinusoidal parameter domain from values received in the data packets before and after the lost packet. This method of interpolation results in the maintenance of relatively good sound quality despite the loss of entire data packets.

Client Decoder and Synthesizer System

Figure 5:
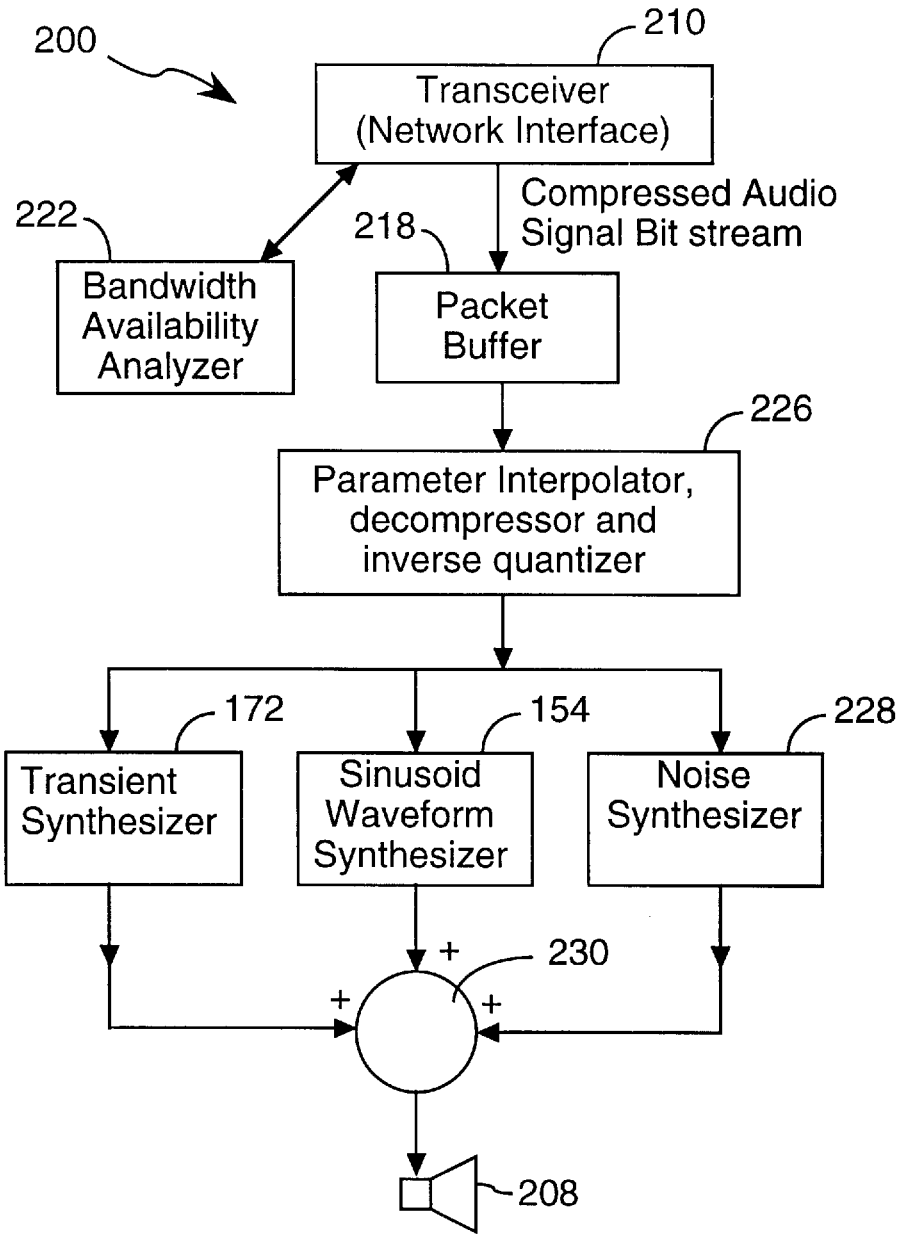
FIGS. 5 and 6 are block diagrams of an audio signal synthesizer that generates audio signals from parameters received from the audio signal analysis system of FIGS. 1 and 2.
Figure 6:
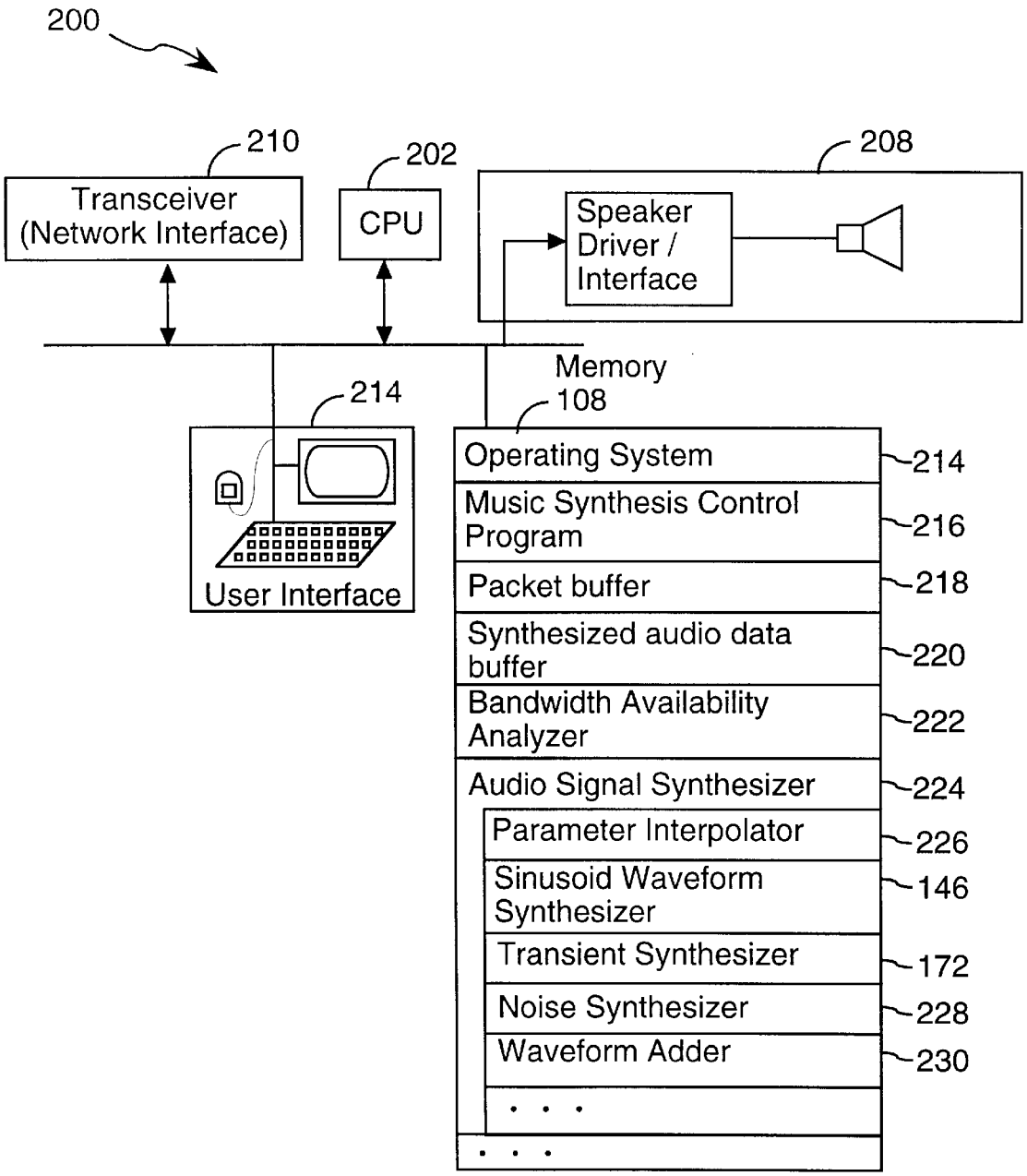

FIG. 5 shows a "signal flow" representation of an audio signal decoder system 200, while FIG. 6 depicts a preferred computer hardware implementation of the same system. The primary purpose of the client decoder system 200 is to synthesize an audio signal from a received, compressed audio data stream. The client decoder system 200 may also determine the available bandwidth of the communication channel between a server and the client decoder system 200 and transmit that information back to the server.

The client system 200 preferably includes a central processing unit (CPU) 202, a user interface 204, an audio output device 208, a data packet transceiver 210 (typically a network interface), and memory 212. In the preferred embodiment, the CPU 202 is a 200 MHz Pentium, 200 MHz Pentium Pro or 200 MHz PowerPC microprocessor, with sufficient data processing capability to synthesize an audio signal from a set of received compressed audio parameters in real time.

In a preferred embodiment, memory 212, which typically includes both random access memory and non-volatile disk storage, can store:

an operating system 214;

an audio signal decoder control program 216;

a receiver buffer 218 for holding one to two seconds of compressed, encoded audio signal data 218;

a synthesized audio data buffer 220 that is typically used to hold two or three time frames (e.g., about 186 to 279 milliseconds) of synthesized audio data samples ready for playing by the audio output device 208;

a bandwidth availability analyzer procedure 222; and a set of audio signal synthesizer procedures 224.

The set of audio signal synthesizer procedures 224 includes:

a parameter interpolator 226;

a sinusoid waveform synthesizer 146, which can be identical to the sinusoid waveform synthesizer 146 used in the analyzer/encoder system 100;

a transient waveform synthesizer 154, which can be identical to the transient waveform synthesizer 154 used in the analyzer/encoder system 100;

a noise synthesizer 228; and a waveform adder 230.

The client decoder system 200 receives packets of compressed audio data from a server system via the client system's transceiver 210. The received packets are temporarily stored in a packet buffer 218. Typically, one to two seconds of audio data are stored in the packet buffer 218. By using a packet buffer, small changes in the transmission rate of data packets will not cause data starvation. The received data packets are surveyed by a bandwidth availability analyzer 222 that detects the rate at which data is actually received from the server, and when that data rate is different from the rate at which the server is sending data, it sends an informational packet back to the server to report the actual available bandwidth.

The packets in the packet buffer are processed by an interpolator, decompression and inverse quantization procedure 226. If data packets have been dropped, or if some model parameters have not been sent by the server due to bandwidth limitations, interpolation is performed to regenerate the lost or unsent parameters. In addition, if some of the least significant bits of the received parameters have been deleted by the server due to bandwidth limitations, the deleted bits are replaced with predefined bit values (e.g., zeros) so as to decompress the transmitted model parameters. Finally, the quantization of the model parameters is reversed so as to regenerate values that are equal to or close to the originally generated model parameters (i.e., sinusoidal waveform, transient waveform and stochastic component parameters).

In addition, some of the parameters, such as those for transient components and stochastic components may be distributed across numerous packets, and those distributed sets of parameters are reconstructed from as many of the received packets as are needed.

The resulting reconstructed model parameters are then used by respective ones of the three synthesizer procedures 154,172 and 228 to synthesize sinusoidal waveforms, transient waveforms and spectrally shaped stochastic noise waveforms. The resulting waveforms are combined by a waveform adder 230 to produce a synthesized audio signal, which is temporarily stored in a buffer 220 until it is ready for output by the audio output device 208. As indicated above, the sinusoid waveform synthesizer 154 and the transient waveform synthesizer 172 both operate in the same manner as was described above with respect to the server analyzer and encoder system 100. The spectrally shaped noise generator 230 is preferably implemented as a lattice filter driven by a random number generator, with the filter's lattice coefficients being determined by the received audio data.

Time and Pitch Modifications

Using the audio signal parameters generated by the audio signal encoder 100, it is relatively easy to make time and pitch modifications to the stored, encoded audio program. In order to stretch a segment of music in time without changing its pitch, a decoder/synthesizer simply changes the spacing of the sinusoidal, transient and noise parameters in time. In order to change the pitch of a piece of music without altering its speed, only the sinusoidal (frequency) component parameters need to be altered.

Time and pitch modifications are important for applications such as browsing through an audio program quickly while maintain intelligibility.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. An audio signal encoder, comprising:

means for filtering a digitally sampled audio signal with a multi-complementary filter bank that splits the audio signal into a plurality of band signals, where the plurality of band signals contain contiguous frequency range portions of the audio signal and wherein the band signals are oversampled so as to suppress cross-band aliasing energy in each of the band signals; and means for analyzing each of the band signals, using for each respective band signal a respective windowing time whose length is inversely proportional to the frequency range of the associated band signal, to identify spectral peaks within each band signal and to generate encoded parameters representing each of the identified spectral peaks.

2. The audio signal encoder of claim 1, further including:

a sinusoidal signal synthesizer for generating a set of sinusoidal waveforms corresponding to the encoded parameters generated by the band signal analyzing means;

a signal subtracter means that subtracts the set of sinusoidal waveforms from the audio signal so as to generate a residual signal; and a transient component analyzer for analyzing and encoding transient signal components in the residual signal with a set of transient component signal parameters.

3. The audio signal encoder of claim 2, the transient component analyzer including:

a transform means for transforming frames of the residual signal into real valued frequency domain frames; and an analyzer for identifying spectral peaks in respective ones of the frequency domain frames and encoding the identified spectral peaks so as to generate the set of transient component signal parameters for the respective ones of the frequency domain frames.

4. The audio signal encoder of claim 3, further including:

a transient signal synthesizer for generating a reconstructed transient signal from the transient component signal parameters;

a second signal subtracter for subtracting the reconstructed transient signal from the residual signal to generate a second residual signal; and a noise component encoder for generating a set of noise modeling parameters representing spectral components of the second residual signal.

5. The audio signal encoder of claim 4, further including:

means for assembling a parameter stream from the encoded parameters representing the identified spectral peaks in the band signals, the transient component signal parameters and the noise modeling parameters; and means for reducing transmission bandwidth associated with the parameter stream by performing a subset of a predefined set of bandwidth reduction actions.

6. The audio signal encoder of claim 5, wherein the predefined set of bandwidth reduction actions includes a plurality of actions selected from the set consisting of deleting from the parameter stream a subset of the encoded parameters representing the identified spectral peaks in the band signals, reducing how often the noise modeling parameters are included in the parameter stream, deleting from the parameter stream all encoded parameters representing the identified spectral peaks a highest frequency one of the band signals, reducing how often the encoded parameters are included in the parameter stream for a second highest frequency one of the band signals, reducing how many bits are used to represent the encoded parameters in the parameter stream, and deleting a subset of the transient component signal parameters.

7. The audio signal encoder of claim 2, further including:

a transient signal synthesizer for generating a reconstructed transient signal from the transient component signal parameters;

a second signal subtracter for subtracting the reconstructed transient signal from the residual signal to generate a second residual signal; and a noise component encoder for generating a set of noise modeling parameters representing spectral components of the second residual signal.

8. The audio signal encoder of claim 7, further including:

means for assembling a parameter stream from the encoded parameters representing the identified spectral peaks in the band signals, the transient component signal parameters and the noise modeling parameters; and means for reducing transmission bandwidth associated with the parameter stream by performing a subset of a predefined set of bandwidth reduction actions.

9. The audio signal encoder of claim 8, wherein the predefined set of bandwidth reduction actions includes a plurality of actions selected from the set consisting of deleting from the parameter stream a subset of the encoded parameters representing the identified spectral peaks in the band signals, reducing how often the noise modeling parameters are included in the parameter stream, deleting from the parameter stream all encoded parameters representing the identified spectral peaks in a highest frequency one of the band signals, reducing how often the encoded parameters are included in the parameter stream for a second highest frequency one of the band signals, reducing how many data bits are used to represent the encoded parameters in the parameter stream, and deleting a subset of the transient component signal parameters.

10. A method of encoding an audio signal, comprising:

filtering a digitally sampled audio signal with a multi-complementary filter bank that splits the audio signal into a plurality of band signals, where the plurality of band signals contain contiguous frequency range portions of the audio signal and wherein the band signals are oversampled so as to suppress cross-band aliasing energy in each of the band signals; and analyzing each of the band signals, using for each respective band signal a respective windowing time whose length is inversely proportional to the frequency range of the associated band signal, to identify spectral peaks within each band signal and to generate encoded parameters representing each of the identified spectral peaks.

11. The method of claim 10, further including:

generating a set of sinusoidal waveforms corresponding to the encoded parameters representing the identified spectral peaks;

subtracting the set of sinusoidal waveforms from the audio signal so as to generate a residual signal; and analyzing and encoding transient signal components in the residual signal with a set of transient component signal parameters.

12. The method of claim 11, the transient signal component analyzing and encoding step including:

transforming frames of the residual signal into real valued frequency domain frames; and identifying spectral peaks in respective ones of the frequency domain frames and encoding the identified spectral peaks so as to generate the set of transient component signal parameters for the respective ones of the frequency domain frames.

13. The method of claim 12, further including:

generating a reconstructed transient signal from the transient component signal parameters;

subtracting the reconstructed transient signal from the residual signal to generate a second residual signal; and generating a set of noise modeling parameters representing spectral components of the second residual signal.

14. The method of claim 13, further including:

assembling a parameter stream from the encoded parameters representing the identified spectral peaks in the band signals, the transient component signal parameters and the noise modeling parameters; and reducing transmission bandwidth associated with the parameter stream by performing a subset of a predefined set of bandwidth reduction actions.

15. The method of claim 14, wherein the predefined set of bandwidth reduction actions includes a plurality of actions selected from the set consisting of deleting from the parameter stream a subset of the encoded parameters representing the identified spectral peaks in the band signals, reducing how often the noise modeling parameters are included in the parameter stream, deleting from the parameter stream all encoded parameters representing the identified spectral peaks a highest frequency one of the band signals, reducing how often the encoded parameters are included in the parameter stream for a second highest frequency one of the band signals, reducing how many bits are used to represent the encoded parameters in the parameter stream, and deleting a subset of the transient component signal parameters.

16. The method of claim 11, further including:

generating a reconstructed transient signal from the transient component signal parameters;

subtracting the reconstructed transient signal from the residual signal to generate a second residual signal; and generating a set of noise modeling parameters representing spectral components of the second residual signal.

17. The method of claim 16, further including:

assembling a parameter stream from the encoded parameters representing the identified spectral peaks in the band signals, the transient component signal parameters and the noise modeling parameters; and reducing transmission bandwidth associated with the parameter stream by performing a subset of a predefined set of bandwidth reduction actions.

18. The method of claim 17, wherein the predefined set of bandwidth reduction actions includes a plurality of actions selected from the set consisting of deleting from the parameter stream a subset of the encoded parameters representing the identified spectral peaks in the band signals, reducing how often the noise modeling parameters are included in the parameter stream, deleting from the parameter stream all encoded parameters representing the identified spectral peaks in a highest frequency one of the band signals, reducing how often the encoded parameters are included in the parameter stream for a second highest frequency one of the band signals, reducing how many data bits are used to represent the encoded parameters in the parameter stream, and deleting a subset of the transient component signal parameters.

19. A computer program product for use in conjunction with a computer system, the computer program product comprising a computer readable storage medium and a computer program mechanism embedded therein, the computer program mechanism comprising:

instructions for filtering a digitally sampled audio signal with a multi-complementary filter bank that splits the audio signal into a plurality of band signals, where the plurality of band signals contain contiguous frequency range portions of the audio signal and wherein the band signals are oversampled so as to suppress cross-band aliasing energy in each of the band signals; and instructions for analyzing each of the band signals, using for each respective band signal a respective windowing time whose length is inversely proportional to the frequency range of the associated band signal, to identify spectral peaks within each band signal and to generate encoded parameters representing each of the identified spectral peaks.

20. The computer program product of claim 19 further including:

instructions for generating a set of sinusoidal waveforms corresponding to the encoded parameters generated by the band signal analyzing means;

instructions that subtract the set of sinusoidal waveforms from the audio signal so as to generate a residual signal; and instructions for analyzing and encoding transient signal components in the residual signal with a set of transient component signal parameters.

21. The computer program product of claim 20, including:

instructions for transforming frames of the residual signal into real valued frequency domain frames; and instructions for identifying spectral peaks in respective ones of the frequency domain frames and encoding the identified spectral peaks so as to generate the set of transient component signal parameters for the respective ones of the frequency domain frames.

22. The computer program product of claim 21, further including:

instructions for generating a reconstructed transient signal from the transient component signal parameters;

instructions for subtracting the reconstructed transient signal from the residual signal to generate a second residual signal; and noise encoding instructions for generating a set of noise modeling parameters representing spectral components of the second residual signal.

23. The audio signal encoder of claim 22, further including:

instructions for assembling a parameter stream from the encoded parameters representing the identified spectral peaks in the band signals, the transient component signal parameters and the noise modeling parameters; and instructions for reducing transmission bandwidth associated with the parameter stream by performing a subset of a predefined set of bandwidth reduction actions.

24. The audio signal encoder of claim 23, wherein the predefined set of bandwidth reduction actions includes a plurality of actions selected from the set consisting of deleting from the parameter stream a subset of the encoded parameters representing the identified spectral peaks in the band signals, reducing how often the noise modeling parameters are included in the parameter stream, deleting from the parameter stream all encoded parameters representing the identified spectral peaks a highest frequency one of the band signals, reducing how often the encoded parameters are included in the parameter stream for a second highest frequency one of the band signals, reducing how many bits are used to represent the encoded parameters in the parameter stream, and deleting a subset of the transient component signal parameters.

25. The audio signal encoder of claim 20, further including:

instructions for generating a reconstructed transient signal from the transient component signal parameters;

instructions for subtracting the reconstructed transient signal from the residual signal to generate a second residual signal; and noise encoding instructions for generating a set of noise modeling parameters representing spectral components of the second residual signal.

26. The audio signal encoder of claim 25, further including:

instructions for assembling a parameter stream from the encoded parameters representing the identified spectral peaks in the band signals, the transient component signal parameters and the noise modeling parameters; and instructions for reducing transmission bandwidth associated with the parameter stream by performing a subset of a predefined set of bandwidth reduction actions.

27. The audio signal encoder of claim 26, wherein the predefined set of bandwidth reduction actions includes a plurality of actions selected from the set consisting of deleting from the parameter stream a subset of the encoded parameters representing the identified spectral peaks in the band signals, reducing how often the noise modeling parameters are included in the parameter stream, deleting from the parameter stream all encoded parameters representing the identified spectral peaks in a highest frequency one of the band signals, reducing how often the encoded parameters are included in the parameter stream for a second highest frequency one of the band signals, reducing how many data bits are used to represent the encoded parameters in the parameter stream, and deleting a subset of the transient component signal parameters.

* * * * *